US008220389B2

(12) United States Patent
Dangelewicz et al.

(10) Patent No.: US 8,220,389 B2
(45) **Date of Patent: *Jul. 17, 2012**

(54) TRAY SURFACE CLEANING DEVICE

(75) Inventors: John A. Dangelewicz, San Diego, CA (US); Dale D. Timm, Solana Beach, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 931 days.

This patent is subject to a terminal disclaimer.

(21) Appl. No.: 12/253,321

(22) Filed: Oct. 17, 2008

(65) Prior Publication Data

US 2009/0151583 A1 Jun. 18, 2009

Related U.S. Application Data

(60) Provisional application No. 61/013,217, filed on Dec. 12, 2007.

(51) Int. Cl.
*B41F 35/00* (2006.01)
*B41J 3/00* (2006.01)

(52) U.S. Cl. ..... 101/423; 101/93; 101/296; 101/474; 347/2; 347/103; 347/104

(58) Field of Classification Search ..... 101/425
See application file for complete search history.

(56) References Cited

U.S. PATENT DOCUMENTS

| | | | | |
|---|---|---|---|---|
| 1,663,049 | A * | 3/1928 | Hill | 101/425 |
| 2,629,323 | A * | 2/1953 | Baumgardner et al. | 101/425 |
| 3,084,626 | A * | 4/1963 | Stobb | 101/425 |
| 3,898,670 | A * | 8/1975 | Erikson et al. | 101/425 |
| 4,538,156 | A | 8/1985 | Durkee et al. | |
| 4,986,182 | A * | 1/1991 | Sawaguchi et al. | 101/425 |
| 5,105,740 | A * | 4/1992 | Loos et al. | 101/425 |
| 5,758,577 | A * | 6/1998 | Ebina | 101/425 |
| 5,899,615 | A | 5/1999 | Sansone | |
| 6,341,860 | B1 | 1/2002 | Harris | |
| 6,481,046 | B1 * | 11/2002 | Freund et al. | 101/423 |

* cited by examiner

*Primary Examiner* — Jill Culler

(57) ABSTRACT

An apparatus and method are disclosed in which printing material is printed upon a tray surface and transferred to a sheet supported by the tray surface. A cleaning device removes residual printing material from the tray surface.

19 Claims, 11 Drawing Sheets

TRAY SURFACE CLEANING DEVICE

CROSS-REFERENCE TO THE RELATED PATENT APPLICATIONS

This application claims the benefit of U.S. provisional patent application Ser. No. 61/013,217, filed on Dec. 12, 2007, entitled TRAY SURFACE CLEANING DEVICE.

The present application is related to U.S. Pat. No. 8,100,489 issued on Jan. 24, 2012 to Dale D. Timm, John A. Dangelewicz, David H. Donovan, Shilin Guo, Behnam Bastani and David Luis Pereira and entitled DOUBLE-SIDED PRINTING SYSTEM, the full disclosure which is hereby incorporated by reference. The present application is related to U.S. patent application Ser. No. 12/253,360 filed on the same day herewith by John A. Dangelewicz and Geoffrey F. Schmid and entitled MEDIA SUPPORT PICK DEVICE, the full disclosure which is hereby incorporated by reference. The present application is related to U.S. patent application Ser. No. 11/625,032 filed on Jan. 19, 2007 by Geoffrey F. Schmid and Kevin T. Kersey an entitled VACUUM RELIEF, the full disclosure which is hereby incorporated by reference. The present application is related to U.S. Pat. No. 7,597,319 issued on Oct. 6, 2009 to John A. Dangelewicz, Kevin T. Kersey, Timothy J. Carlin, Geoffrey F. Schmid and Michael A. Novick an entitled SHEET HANDLING USING A RAMP AND GRIPPERS ON AN ENDLESS BELT, the full disclosure which is hereby incorporated by reference.

BACKGROUND

It is sometimes desirable to print on opposite sides of the sheet. Existing systems for printing on both sides of the sheet may be complex, expensive and space consuming.

DETAILED DESCRIPTION OF THE EXAMPLE EMBODIMENTS

Figure 1:
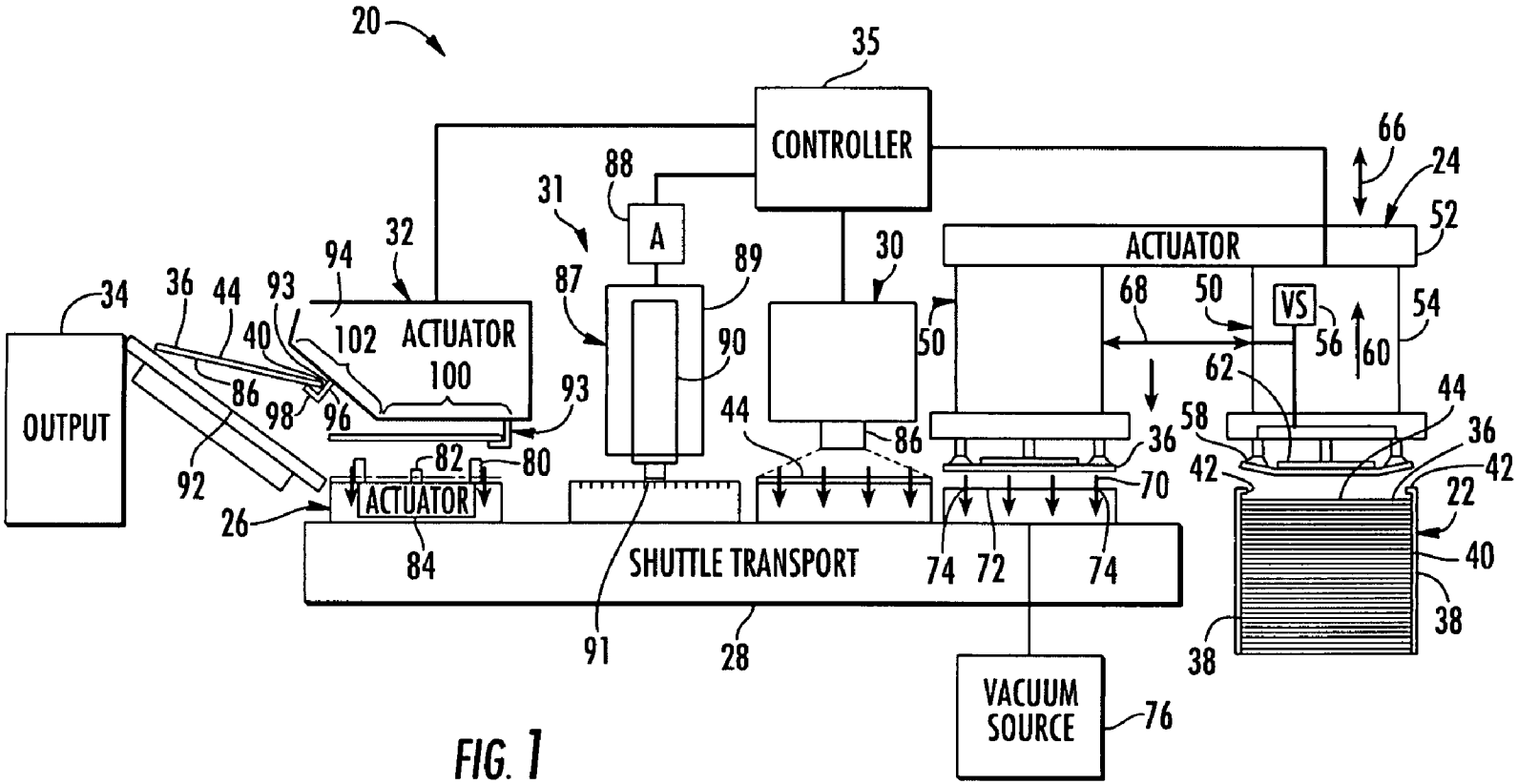
FIG. 1 is a schematic illustration of a printing system according to an example embodiment.

FIG. 1 schematically illustrates printing system 20 which is configured to handle sheets of media and to perform one or more processes upon the media such as depositing or printing fluid, such as ink, upon such media. System 20 is configured to print or form an image upon a tray surface, wherein the image is transferred to a bottom side of a sheet supported by the tray surface. As will be described hereafter, system 20 is further configured to clean residual printing material from the tray surface.

Printing system 20 generally includes sheet supply station 22, pick mechanism 24, shuttle tray 26 (shown at four positions), shuttle transport 28, print station 30, cleaning station 31, off-load station 32 and output 34. Sheet supply station 22 stores and supplies individual sheets 36 of media to printing system 20. Sheet supply station 22 includes one or more sidewalls 38 which engage edges 40 of sheets 36 to align sheets 36 such that sheets 36 are consistently positioned with respect to pick mechanism 24. Sheet supply station 22 additionally includes projections 42 which extend above a top face 44 and across the corners of the uppermost sheet 36 of the stack of sheets 36. In other embodiments, projections 42 may be omitted.

Pick mechanism 24 comprises a mechanism configured to pick the uppermost sheet 36 from sheet supply station 22 and to deposit the picked sheet 36 upon shuttle tray 26. Pick mechanism 24 includes pick unit 50 and actuator 52 (shown at two positions). Pick unit 50 picks or grasps the uppermost sheet 36 from sheet supply station 22 and generally includes body 54, vacuum source 56, vacuum cups 58 and pressure member 60. Body 54 is coupled to actuator 52 and generally houses and supports the remaining components of pick unit 50. Vacuum source 56 comprises a device configured to create a vacuum for each of vacuum cups 58. In one embodiment, vacuum source 56 comprises a blower carried by body 54 and in communication with cavities of vacuum cups 58. In other embodiments, other vacuum sources may be utilized.

Vacuum cups 58 generally comprise members extending from body 54 in communication with vacuum source 56 and configured to substantially seal against top face 44 of a sheet 36 while applying a vacuum to top face 44 so as to hold a sheet 36 against cups 58. Vacuum cups 58 are peripherally located about pressure member 60. In one embodiment, pick unit 50 includes four vacuum cups 58 configured to contact top face 44 of sheet 36 proximate to the four corners of sheet 36. In other embodiments, pick unit 50 may include a greater or fewer of such vacuum cups at other locations.

Pressure member 60 comprises a member having a surface 62 supported by and movable relative to body 54 between an extended position in which surface 62 extends beyond cups 58 and a retracted position in which surface 62 is substantially even with or withdrawn relative to the terminal portions of cups 58. Pressure member 60 is further configured such that surface 62 is resiliently biased towards the extended position. In the example shown, surface 62 is centrally located between vacuum cups 58 so as to generally contact the central portion of face 44 of a sheet 36 of media when picking a sheet of media.

Actuator 52 generally comprises a mechanism configured to move pick unit 50. In the particular example shown, actuator 52 is configured to raise and lower pick unit 50 relative to sheet supply station 22 as indicated by arrows 66. Actuator 52 is also configured to move pick unit 50 in the direction indicated by arrows 68 between a position generally opposite to sheet supply station 22 and another position generally opposite to shuttle tray 26. Actuator 52 may comprise a hydraulic or pneumatic cylinder-piston assembly, an electric solenoid, a motor and a transmission including one or more belts, pulleys, gear assemblies or cams or other mechanisms to actuate or move pick unit 50.

In response to receiving control signals from controller 35, actuator 52 lowers pick unit 50 towards an uppermost sheet 36 at sheet supply station 22 while surface 62 is in the extended position. As a result, surface 62 will initially contact top face 44 of an uppermost sheet 36. Continued lowering of pick unit 50 by actuator 52 results in surface 62 being moved to the retracted position as vacuum cups 58 are brought into contact with face 44 of sheet 36. In response to receiving signals from controller 35, vacuum source 56 applies a vacuum through vacuum cups 58 such that the uppermost sheet 36 is grasped. Thereafter, actuator 52 lifts pick unit 50 which results in the held sheet 36 also being lifted. During such lifting, surface 62 resiliently returns to its extended position, resulting in the corners of sheet 36 gripped by the vacuum of vacuum cups 58 being upwardly bent or curved to peel the uppermost sheet 36 from underlying sheets 36 at sheet supply station 22.

As pick unit 50 is lifted, the corners of the uppermost sheet 36 grasped by pick unit 50 engage projections 42. Projections 42 temporarily bend or deform the corners of such sheets 36 in a downward direction as pick unit 50 is lifted. Once the corners of the grasped sheet 36 have been lifted beyond projections 42, the corners resiliently return to an upward orientation, creating a breaking away force between the grasped sheet 36 and any underlying sheet 36 which may be adhering to the grasped sheet 36.

Overall, the generally consistent positioning of sheets 36 by sheet supply station 22, the bending or arcing of a grasped sheet by vacuum cups 58 and pressure member 60 and the engagement of projections 42 with corners of the grasped sheet 36 facilitate separation of grasped sheet 36 from any underlying sheets to reduce the likelihood of multiple sheets being accidentally picked and to reduce the likelihood of resulting media jams within an interaction system 20. Once a sheet 36 has been picked by pick unit 50, actuator 52 moves pick unit 50 to a position opposite to shuttle tray 26 and vacuum source 56 either terminates the supply of vacuum or blows air through vacuum cups 58 to release the grasped sheet 36 and to deposit the sheet 36 upon tray 26.

Shuttle tray 26 comprises a member configured to support and hold a sheet 36 of media as the media is transported between pick unit 50, print station 30, cleaning station 31 and off-load station 32. As schematically indicated by arrows 70, shuttle tray 26 has a platform surface 72 including a plurality of vacuum ports 74 which are in communication with a vacuum source 76. Vacuum source 76 creates a vacuum through each of ports 74 to retain sheet 36 in place along surface 72. In particular embodiments, the vacuum applied through vacuum ports 74 may additionally be used to facilitate transfer of sheet 36 from pick unit 50.

As further shown by the shuttle tray 26 illustrated in a position opposite to off-load station 32, shuttle tray 26 additionally includes sheet lifters 80, 82 and actuator 84. Sheet lifters 80 and 82 comprise members carried by shuttle tray 26 and movable between a retracted position in which ends of lifters 80, 82 are level or recessed below platform surface 72 within tray 26 and an extended position in which ends of lifters 80, 82 project above platform surface 72 to lift the sheet 36 away from platform surface 72.

Actuator 84 comprises a mechanism to move sheet lifters 80, 82 between the retracted position and the extended position. In one embodiment, actuator 84 moves lifters 80, 82 to their extended positions, while allowing lifters 80, 82 to move to their retracted positions under the force of gravity. In other embodiments, actuator 84 moves lifters 80, 82 from the retracted positions to their extended positions and from their extended positions to their retracted positions. In one embodiment, actuator 84 is self contained within shuttle tray 26. In another embodiment, actuator 84 may additionally include components permanently located at off-load station 32. Actuator 32 may utilize pneumatic or hydraulic cylinder-piston assemblies, electric solenoids, motors and transmissions with belts, pulleys, cams and the like or other mechanisms configured to selectively move lifters 80, 82 between their extended and retracted positions.

In the particular example illustrated, lifters 80 extend above platform surface 72 by a distance different than that of lifter 82. As a result, the sheet of media is supported by lifters 80, 82 is in an arced or bent configuration. The bent configuration of the sheet 36 results in sheet 36 being stiffer to facilitate removal of sheet 36 from tray 26 at off-load station 32 as will be described in greater detail hereafter. In one embodiment, lifter 82 is centrally located so as to engage a center portion of sheet 36 while lifters 80 are peripherally located so as to engage peripheral portions of sheet 36. According to one example embodiment, shuttle tray 26 includes four lifters 80 configured to engage a bottom 86 of sheet 36 proximate to the corners of sheet 36. In their extended positions, lifters 80, 82 lift sheet 36 away from platform surface 72 to break the vacuum seal otherwise formed by vacuum ports 74. In other embodiments, shuttle tray 26 may include a greater or fewer of lifters 80, 82 at different locations along platform surface 72 and movable between different heights relative to and movable between alternative heights relative to platform surface 72.

Shuttle transport 28 comprises a mechanism configured to move shuttle tray 26 between pick unit 50, print station 30, cleaning station 31 and off-load station 32. In one embodiment, shuttle transport 28 comprises an endless belt or chain coupled to shuttle transport 26 and configured to move shuttle transport 26 along the guides as a rod, bar or support surface. In another embodiment, shuttle transport 28 may comprise a motor and screw mechanism, a motor and rack and pinion mechanism, a hydraulic or pneumatic piston-cylinder assembly, an electric solenoid or other mechanisms configured to linearly translate shuttle tray 26.

Print station 30 comprises a station at which an image of printing material is formed upon at least a portion of platform surface 72 for subsequent transfer to a bottom side of a sheet subsequently positioned upon platform surface 72. In the example illustrated, print station 30 also comprises a station at which an image of printing material is formed upon a second opposite topside of sheet 36 supported by shuttle tray 26. In the embodiment shown, print station 30 is configured to deposit fluid, such as ink, upon both platform surface 72 of tray 26 and top face 44 of sheet 36, at different times.

During printing of an image on face 44, fluid is deposited upon face 44 while sheet 36 is held by vacuum applied through vacuum ports 74 as indicated by arrows 70. In the particular embodiment illustrated, print station 30 includes a print device 86 configured to deposit fluid, such as ink, across substantially the entire face 44 during a single pass of shuttle tray 26 relative to print station 30. In another embodiment, print station 30 and print device 86 may alternatively be configured to be moved or scanned relative to surface 44 of sheet 36. In one embodiment, print device 86 comprises one or more drop-on-demand inkjet print heads. In other embodiments, print device 86 may comprise other devices configured to deposit fluid upon face 44 or to otherwise form an image upon face 44 of sheet 36. Although system 20 is illustrated as utilizing a single print station 30 for printing images upon both platform surface 72 of tray 26 and upon face 44 of sheet 36, in other bombings, distinct printing devices or distinct printing stations may alternatively be utilized to print upon the different surfaces.

Cleaning station 31 comprises a station at which residual printing material (the printing material remaining after the printed image upon platform surface 72 has been transferred to a bottom side of sheet 36) upon platform surface 72 is cleaned or removed from platform surface 72. Cleaning station 31 includes cleaning device 87 and actuator 88. Cleaning device 87 comprises a mechanism configured to be brought into contact with platform surface 72 to wipe remove residual ink from platform surface 72 of tray 26. In the example illustrated, cleaning device 87 includes a support or carrier 89 and a cleaning cartridge 90.

Carrier 89 comprises a framework, housing or receiver configured to be removably connected to or to removably receive and support cartridge 90 at a suspended location opposite to and above a path of shuttle tray 26. In one embodiment, carrier 89 is configured to be removably coupled to cartridge 90 such that cartridge 90 may be joined to or separated from carrier 89 manually and without the use of tools. For example, in one embodiment, one or more resiliently flexible snaps, latches or other mechanisms may be used to secure and retain cartridge 90 relative to carrier 89. In other embodiments, carrier 89 may be removably coupled to cartridge 90 with the use of tools. For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. The term "operably coupled" shall mean that two members are directly or indirectly joined such that motion may be transmitted from one member to the other member directly or via intermediate members.

Cartridge 90 comprises a substantially self-contained unit configured to be removably coupled to carrier 89 and providing a cleaning surface 91. Cleaning surface 91 is configured to be brought into contact with platform surface 72 so as to remove residual printing material, such as residual ink, from platform surface 72 of tray 26. In one embodiment, cleaning surface 91 may comprise a flexible or elastomeric material, such as a rubber or rubber-like wiping blade or roller. In another embodiment, cleaning surface 91 may comprise an absorbent material such as an absorbent pad or an absorbent roller. In yet another embodiment, cleaning surface 91 may be provided by a web of absorbent or non-absorbent material. In some embodiments, the web may be supplied from a supply roll, wherein used portions of the web are taken up by a take-up roll and refreshed with clean portions of the web. Because cartridge 90 is removably coupled to carrier 89, cartridge 90 and its cleaning surface 91 may be replaced when cleaning surface 91 becomes damaged, worn or soiled without the entirety of cleaning device 87 having to be replaced.

Actuator 88 comprises a mechanism configured to selectively raise and lower cleaning device 87, including carrier 89 and cartridge 90, with respect to tray 26. In particular, actuator 88 is configured to raise cleaning device 87 when shuttle transport 28 is moving tray 26 past cleaning station 31 or after platform surface 70 has been cleaned. Actuator 88 is configured to lower cleaning device 87 and position cleaning surface 91 into contact with platform surface 72 when tray 26 is positioned by shuttle transport 28 opposite to cleaning station 31 and when platform surface 72 is to be cleaned.

Although actuator 88 is configured to move cleaning device 89 in directions substantially perpendicular to platform surface 72, in other embodiments, actuator 88 may additionally or alternatively be configured to move cleaning device 87 in directions parallel to platform surface 72. Although cleaning device 87 is illustrated as including carrier 89 and the removable cartridge 90, in other embodiments, cartridge 90 may be omitted, wherein cleaning surface 91 is provided directly as part of carrier 89. In some embodiments, actuator 88 may also be omitted.

Off-load station 32 is configured to remove the printed upon sheet 36 from shuttle tray 26 and to transport the removed sheet to output 34. Off-load station 32 generally includes slide 92, trucks 93 and actuator 94. Slide 92 comprises a surface extending between platform surface 72 of shuttle tray 26 and output 34. In the particular example shown, slide 92 is inclined so as to form an upwardly extending ramp from shuttle tray 26 to output 34. As a result, output 34 may be positioned at a higher location to facilitate removal of printed upon sheets. In other embodiments, slide 92 may be supported at other orientations.

Trucks 93 comprise structures configured to engage and move a printed upon sheet 36 from shuttle tray 26 along slide 92 to output 34. Each truck 93 generally includes a leg 96 and a foot 98. Leg 96 extends from actuator 94 and is generally configured to engage or contact edge 40 of sheet 36. Foot 98 extends from leg 96 and is configured to extend along and contact a bottom face 86 of sheet 36. As a result, each truck 93 engages sheet 96 without substantially contacting printed upon face 44 to reduce the likelihood of smearing, scratching or otherwise damaging printed upon face 44 of sheet 36.

Trucks 93 are configured to move along a sheet removing path 100 and along a sheet transporting path 102. When moving along the sheet removing path 100, trucks 93 push sheet 36 in a generally horizontal direction across lifters 80, 82 onto slide 92. When moving along the sheet transporting path 102, trucks 93 push sheet 36 along slide 92 into output 34.

Actuator 94 comprises a device configured to move trucks 93 along the sheet removing path 100 and the sheet transporting path 102 in response to control signals from controller 35. In one embodiment, actuator 94 comprises an endless belt, chain or web coupled to each of trucks 93 and driven by a motor or other torque source to move trucks 93 along paths 100, 102. In other embodiments, actuator 94 may have other configurations and may utilize other sources such as hydraulic or pneumatic piston-cylinder assemblies, solenoids and the like to move trucks 93 along paths 100, 102.

Output 34 generally comprises a structure configured to receive and potentially store printed upon sheets 36 until retrieved. In one embodiment, output 34 may comprise a tray. In another embodiment, output 34 may comprise a bin.

Controller 35 generally comprises a processing unit configured to generate control signals which are communicated to pick mechanism 24, shuttle tray 26, shuttle transport 28, print station 30, cleaning station 31 and off-load station 32 to direct the operation of such devices or stations. For purposes of this disclosure, the term "processing unit" shall mean a conventionally known or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. Controller 35 is not limited to any specific combination of hardware circuitry and software, nor to any particular source for the instructions executed by the processing unit.

According to one example embodiment, controller 35 generates control signals initially directing shuttle transport 28 to position a clean and empty platform surface 72 of tray 26 opposite to print station 30. Controller 35 then generates control signals directing print station 35 to print an image a printing material upon at least portions of platform surface 72. Once the image is printed upon platform surface 72, controller 35 generates control signals directing shuttle transport 28 to move tray 26 to a position proximate to sheet supply station 22. Controller 35 generates control signals directing pick mechanism 24 to pick and deposit a sheet 36 upon platform surface 72 of shuttle tray 26 as described in detail above. While sheet 36 rests upon platform surface 72 of shuttle tray 26, the image of printing material previously printed upon platform surface 72 is brought into contact with the backside of the sheet 36. As a result, the image of print material is stamped or transferred to the backside of sheet 36.

At least while sheet 36 is resting upon platform surface 72 of tray 26, controller 35 generates control signals directing vacuum source 76 to apply a vacuum through ports 74 to the sheet 36 placed upon shuttle tray 26. After sheet 36 has been placed upon tray 26, controller 35 generates control signals directing shuttle transport 28 to transfer shuttle tray 26 to print station 30. Once shuttle transport 26 and the sheet 36 it carries are positioned opposite print station 30, controller 35 generates control signals directing print device 86 to deposit fluid, such as ink, upon face 44 of sheet 36 while vacuum source 76 continues to hold sheet 36 in place by applying a vacuum through ports 74.

Upon completion of the deposition of fluid upon face 44 of sheet 36, controller 35 generates further control signals directing shuttle transport 28 to transfer shuttle tray 26 to off-load to a position opposite off-load station 32. Upon positioning of shuttle tray 26 at off-load station 32, controller 35 generates control signals directing actuator 84 to move lifters 80, 82 to their extended positions and to optionally cease or reduce the application of vacuum by vacuum source 76. Controller 35 further generates control signals directing actuator 94 to drive trucks 93 such that trucks 93 engage bottom 86 and edge 40 to move sheet 36 off of lifters 80, 82 and onto slide 92. In one embodiment, actuator 94 moves the off-loaded sheet 36 into output 34 without an interruption. In another embodiment, actuator 94 may temporarily pause with an off-loaded sheet 36 resting upon slide 92 while fluid or printing material dries or otherwise solidifies upon surface 44. After a predetermined period of time, actuator 94 continues operation to continue to drive trucks 93 to move the sheet 36 to output 34.

After the sheet 36, which has been printed on both of its opposite faces or sides, has been unloaded, controller 35 generates control signals directing shuttle transport 28 to move and position shuttle tray 26 at or proximate to cleaning station 31. Once shuttle tray 26 is located at cleaning station 31, controller 35 generates control signals directing cleaning station 31 to remove any residual printing material upon platform surface 72 of tray 26. In the particular example illustrated, controller 35 generates control signals directing actuator 88 to lower cleaning device 87 so as to position cleaning surface 91 in contact with platform surface 72 of tray 26. While cleaning surface 91 is in contact with platform surface 72, controller 35 generates control signals directing shuttle transport 28 to move platform surface 74 relative to cleaning surface 91 to effectuate cleaning. In one embodiment, controller 35 generates control signals such that shuttle transport 28 reciprocates platform surface 74 back-and-forth across cleaning surface 91.

In other embodiments in which actuator 88 is configured to move cleaning device 87 and directions parallel to platform surface 72, controller 35 may generate additional control signals directing actuator 88 to move cleaning device 87 back-and-forth across platform surface 72 to clean residual printing material from platform surface 72. In some embodiments, both cleaning device 87 and shuttle tray 26 may be moved relative to one another by actuator 88 and shuttle transport 28 in directions parallel to platform surface 72 to effectuate cleaning. In still other embodiments in which cleaning surface 91 is sufficiently large so as to address the entire printed upon region of a formed surface 72, clean device 87 and shuttle tray 26 may remain stationary relative to one another during removal of the residual printing material. In one embodiment, cleaning device 87 may be substantially stationary while just cleaning surface 91 is moved relative to platform surface 72. For example, in embodiments where cleaning surface 91 is provided by a web, the web may be moved relative to platform surface 72 to wipe platform surface 72. Once residual printing material has been sufficiently removed from a formed surface 72, controller 35 generates control signals directing shuttle transport 28 to once again position platform surface 72 of tray 26 opposite to printing station 30 for printing an image of printing material upon at least portions of platform surface 72. The process described above is then repeated for a second sheet 36.

Figure 2:
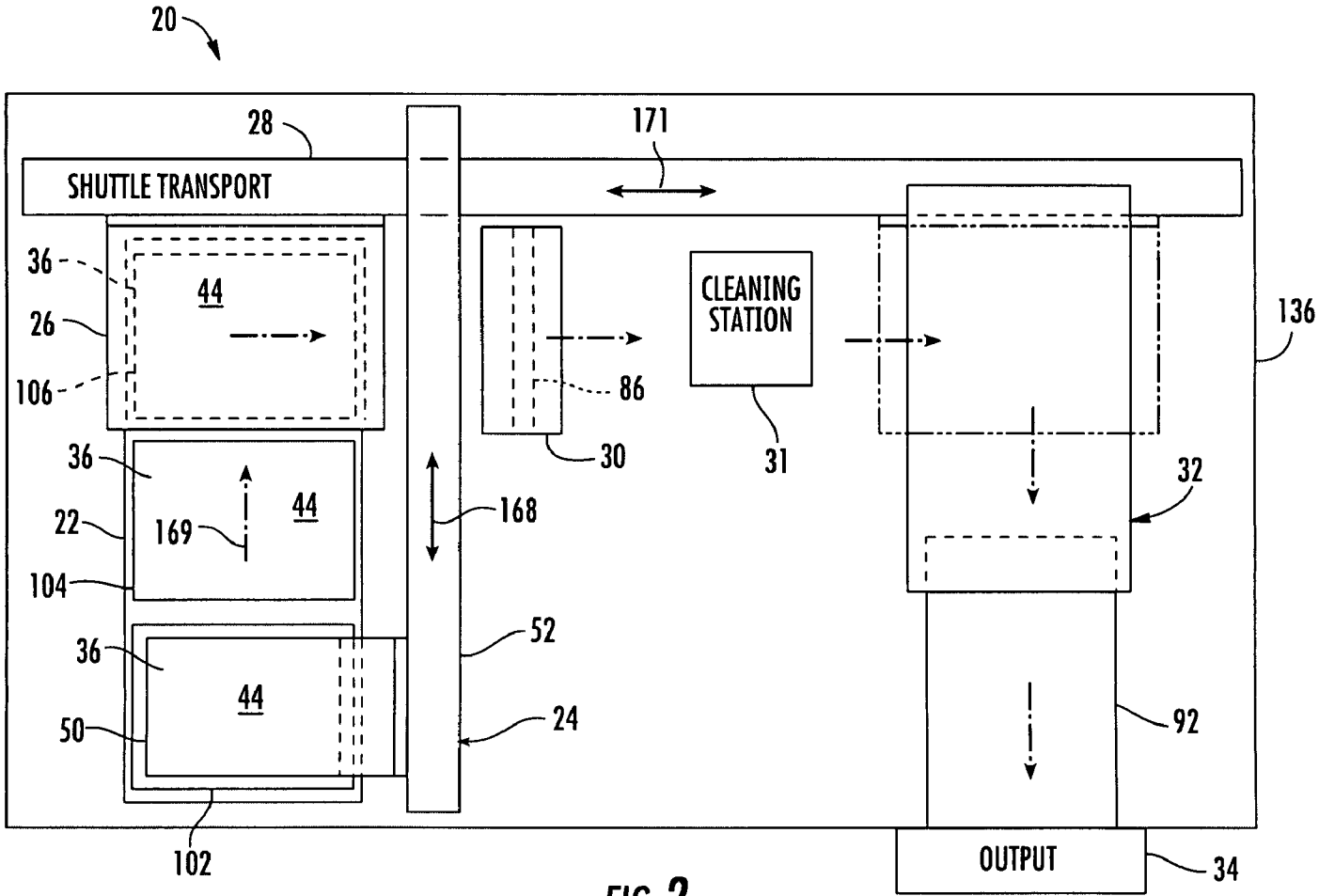
FIG. 2 is a top plan view schematically illustrating the printing system of FIG. 1 according to an example embodiment.

Although FIG. 1 illustrates each of stations 22, 30, 31 and 32 in a sequential and serial line for purposes of illustration, the arrangement or layout of such stations may have other configurations. FIG. 2 illustrates one example layout of system 20. As shown by FIG. 2, each of sheet supply station 22, pick mechanism 24, shuttle tray 26, shuttle transport 28, print station 30, cleaning station 31, off-load station 32 and output 34 are housed, contained or otherwise supported by an overall housing or framework 136 which connects all of the components of printing system 20 as a single unit such as a kiosk. In other embodiments, printing system 20 may alternatively be provided by distinct sections mounted or positioned proximate to one another.

As further shown by FIG. 2, sheet supply station 22 includes individual magazines 102, 104 and 106 from which a sheet 36 may be picked by pick mechanism 24. Each magazine 102, 104, 106 is configured to contain a stack of sheets 36. In one embodiment, magazines 102, 104 and 106 may be configured to contain differently sized sheets 36 or sheets 36 of different media. In another embodiment, magazines 102, 104 and 106 may be configured to supply sheets 36 having the same size and comprising the same media type. Although station 22 is illustrated as including three distinct magazines, and other bombs, station 22 may include a greater or fewer of such magazines.

As shown by FIG. 2, pick actuator 52 of pick mechanism 24 is configured to move pick unit 50 along and over the top of each of magazines 102, 104 and 106 of sheet supply station 12 in the direction indicated by arrows 168. Once a sheet 36 is picked by pick unit 50, actuator 52 moves pick unit 50 and the grasped sheet 36 in the direction indicated by arrow 169 to a position over magazine 106. In the particular example shown, shuttle tray 26 is movable to a position above magazine 106 of sheet supply station 22 and between magazine 106 and pick unit 50. As a result, a sheet 36 carried by pick unit 50 may be deposited upon shuttle tray 26 while pick unit 50 is positioned above both shuttle tray 26 and magazine 106. In a scenario where a sheet 36 is to be picked from magazine 106, shuttle tray 26 is initially moved out from above magazine 106, pick unit 50 then picks a sheet 36 from magazine 106 and shuttle tray 26 is then moved between magazine 106 and pick unit 50 for receiving the sheet 36. Because shuttle tray 26 is configured to receive a picked sheet 36 from pick unit 50 while shuttle tray 26 is over magazine 106, the overall architecture of printing system 20 occupies less space and is more compact.

Shuttle transport 28 comprises a mechanism configured to move shuttle tray 26 in the direction indicated by arrows 171 between a position above magazine 106, a position generally opposite to printing station 30 and a position generally opposite to off-load station 32. As shown by FIG. 2, shuttle transport 28 moves shuttle tray 26 along an axis generally perpendicular to an axis along which pick unit 50 is moved and perpendicular to the arrangement of magazines 102, 104 and 106. As a result, the overall length of magazines 102, 104 and 106 is reduced and the shorter dimension or width of each sheet 36 passes beneath print station 30 or with a shorter scan length. In other embodiments, the arrangement between magazines 102, 104, 106, pick mechanism 24, shuttle tray 26 and shuttle transport 28 may have other configurations.

FIGS. 3-11 illustrate system 220, another embodiment of system 120. System 220 includes sheet supply station 22, pick mechanism 24, print station 30, off-load station 32 and output 34, each of which is shown and described with respect to FIG. 1. System 220 is similar to system 20 except that system 220 includes shuttle tray 226, shuttle transport 228 and cleaning station 231 in place of shuttle tray 26, shuttle transport 28 and cleaning station 31, respectively. Shuttle tray 226, shuttle transport 228 and cleaning station 231 comprise particular example embodiments of shuttle tray 26, shuttle transport 28 and cleaning station 31, respectively.

Figure 3:
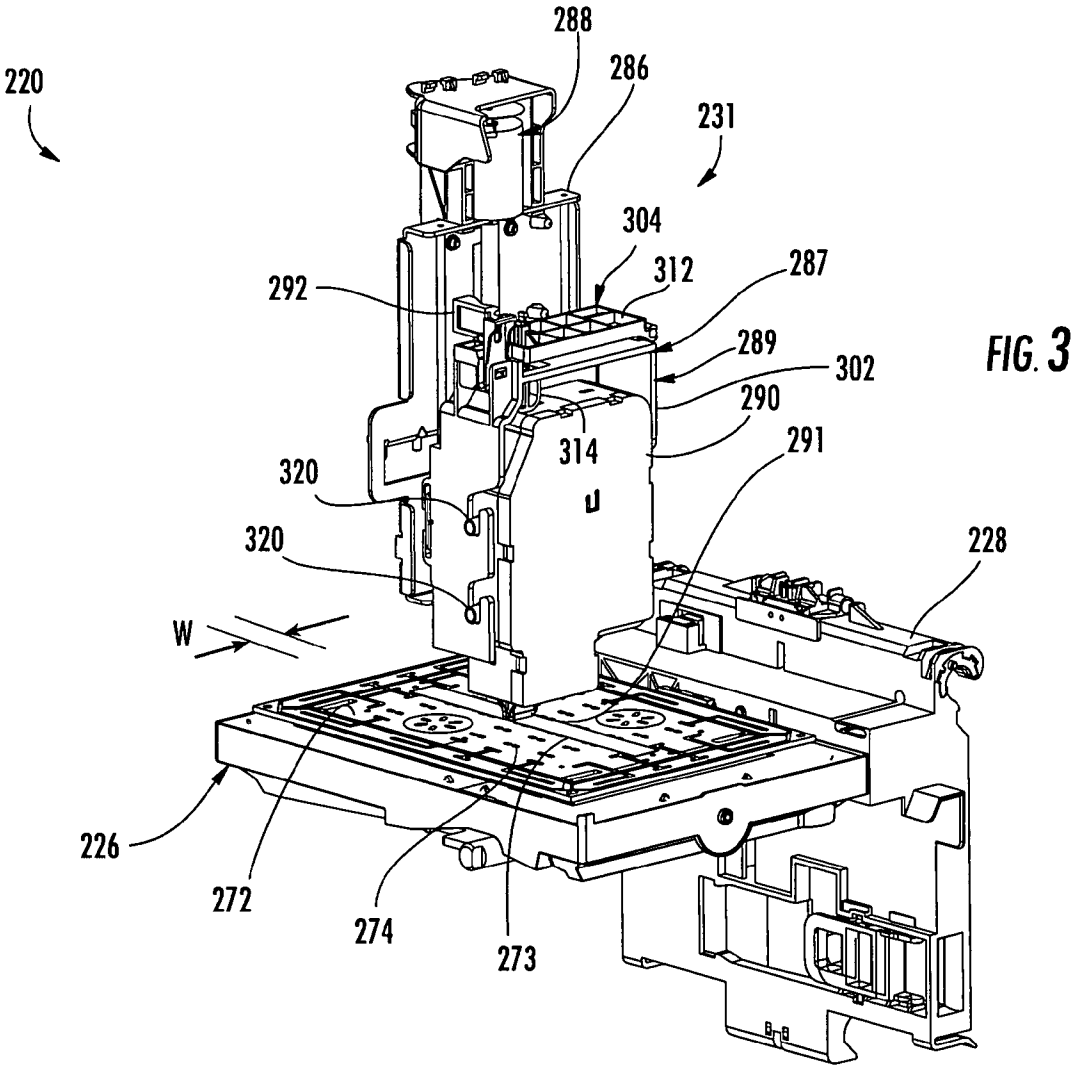
FIG. 3 is a top perspective view of another embodiment of the printing system of FIG. 1 illustrating a tray opposite a cleaning station according to an example embodiment.

As shown by FIG. 3, shuttle tray 226 comprises a member configured to support and hold a sheet 36 (shown in FIG. 1) of media as the media is transported between pick unit 50, print station 30, cleaning station 231 and off-load station 32. Shuttle tray 226 includes a platform surface 272 having a print region 273 and a plurality of vacuum ports 274. Print region 273 comprises an area on surface 272 configured to be printed upon by print device 86 at print station 30 (shown in FIG. 1). In the particular embodiment illustrated, print region 273 is formed from one more materials providing a surface adapted to transfer printing material to an overlying sheet 36. In one embodiment, print region 273 is formed from a relatively smooth non-absorbent material. In one embodiment, region 273 is formed from polytetrafluoroethylene (Teflon). In other embodiments, region 273 may be formed from other materials.

According to one embodiment, print region 273 comprises a strip centrally located along surface 272 extending and having a major dimension in a direction substantially parallel to the direction in which shuttle transport 228 moves tray 226. Print region 273 further has a width W less than or equal to a corresponding width of a cleaning surface 291 at cleaning station 231. As a result, an entirety of region 273 may be brought into contact with and cleaned during a single swipe or pass of tray 226 across cleaning surface 291 by shuttle transport 228. In another embodiment, print region 273 may have other dimensions, may be provided at other portions of tray 226 and may alternatively comprise multiple distinct spaced regions along tray 226.

Vacuum ports 274 comprise openings through surface 272 that are in communication with a vacuum source 76 (schematically shown in FIG. 1). Vacuum source 76 creates a vacuum through each of ports 274 to retain sheet 36 in place along surface 72. In particular embodiments, the vacuum applied through vacuum ports 74 may additionally be used to facilitate transfer of sheet 36 from pick unit 50.

As shown and described with respect to FIG. 1, shuttle tray 226 additionally includes sheet lifters 80, 82 and actuator 84. Sheet lifters 80 and 82 comprise members carried by shuttle tray 26 and movable between a retracted position in which ends of lifters 80, 82 are level or recessed below platform surface 272 within tray 226 and an extended position in which ends of lifters 80, 82 project above platform surface 272 to lift the sheet 36 away from platform surface 272.

Actuator 84 comprises a mechanism to move sheet lifters 80, 82 between the retracted position and the extended position. In one embodiment, actuator 84 moves lifters 80, 82 to their extended positions, while allowing lifters 80, 82 to move to their retracted positions under the force of gravity. In other embodiments, actuator 84 moves lifters 80, 82 from the retracted positions to their extended positions and from their extended positions to their retracted positions. In one embodiment, actuator 84 is self contained within shuttle tray 226. In another embodiment, actuator 84 may additionally include components permanently located at off-load station 32. Actuator 32 may utilize pneumatic or hydraulic cylinder-piston assemblies, electric solenoids, motors and transmissions with belts, pulleys, cams and the like or other mechanisms configured to selectively move lifters 80, 82 between their extended and retracted positions.

In the particular example illustrated, lifters 80 extend above platform surface 272 by a distance different than that of lifter 82. As a result, the sheet of media is supported by lifters 80, 82 is in an arced or bent configuration. The bent configuration of the sheet 36 results in sheet 36 being stiffer to facilitate removal of sheet 36 from tray 226 at off-load station 32 as will be described in greater detail hereafter. In one embodiment, lifter 82 is centrally located so as to engage a center portion of sheet 36 while lifters 80 are peripherally located so as to engage peripheral portions of sheet 36. According to one example embodiment, shuttle tray 226 includes four lifters 80 configured to engage a bottom 86 of sheet 36 proximate to the corners of sheet 36. In their extended positions, lifters 80, 82 lift sheet 36 away from platform surface 272 to break the vacuum seal otherwise formed by vacuum ports 74. In other embodiments, shuttle tray 226 may include a greater or fewer of lifters 80, 82 at different locations along platform surface 272 and movable between different heights relative to and movable between alternative heights relative to platform surface 272.

Shuttle transport 228 comprises a mechanism configured to move shuttle tray 226 between pick unit 50, print station 30, cleaning station 231 and off-load station 32 (shown in FIG. 1). In one embodiment, shuttle transport 228 comprises an endless belt or chain (not shown) coupled to shuttle tray 226 and configured to move shuttle tray 226 along guides (not shown) such as a rod, bar or support surface. In another embodiment, shuttle transport 228 may comprise a motor and screw mechanism, a motor and rack and pinion mechanism, a hydraulic or pneumatic piston-cylinder assembly, an electric solenoid or other mechanisms configured to linearly translate shuttle tray 226.

Figure 4:
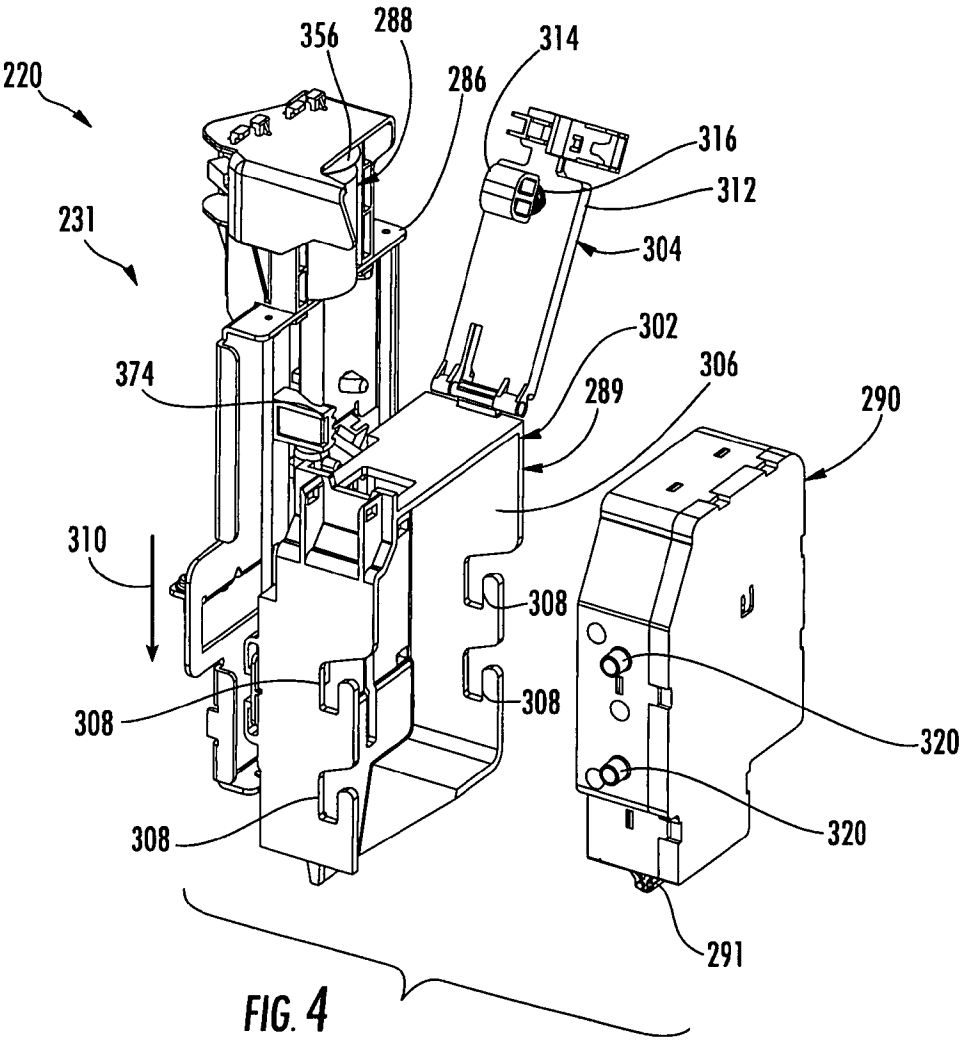
FIG. 4 is an exploded top perspective view of the cleaning station of FIG. 3 according to an example embodiment.
Figure 11:
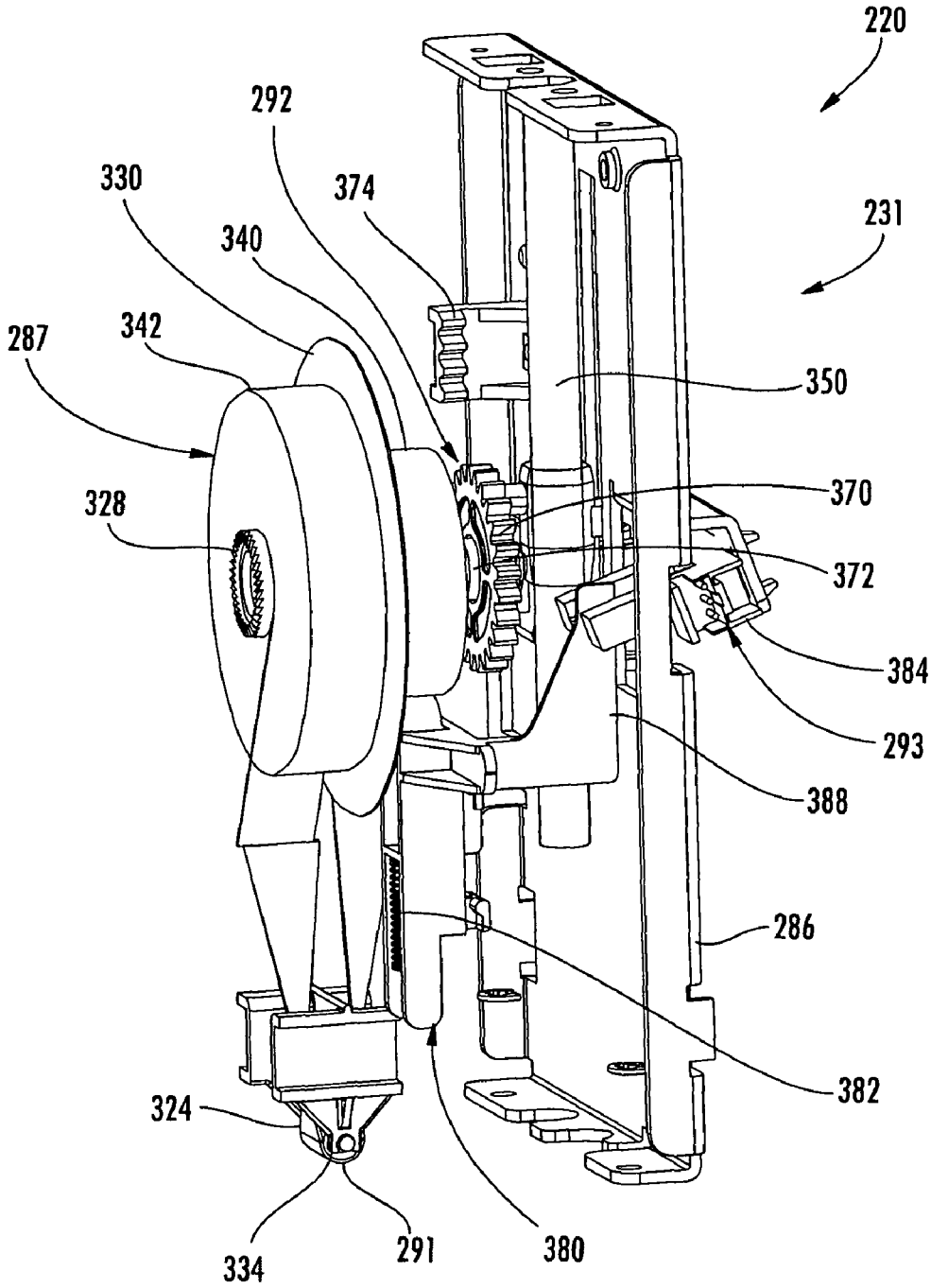
FIG. 11 is a top perspective view of the cleaning station of FIG. 6, illustrating the web sensing system and a second state according to an example embodiment.

As shown by FIGS. 3 and 4, cleaning station 231 includes frame 286, cleaning device 287 including carrier 289 and cartridge 290, actuator 288, web feeding system 292 and web sensing system 293 (shown in FIG. 11). Frame 286 comprises a housing, a bracket or other structure extending adjacent to a path of shuttle transport 228. Frame 286 is configured to support or suspend cleaning device 287, either directly or indirectly via actuator 288, above or relative to the path of shuttle transport 228. As will be described hereafter, frame 286 further supports actuator 288 and portions of web sensing system 293.

Figure 5:
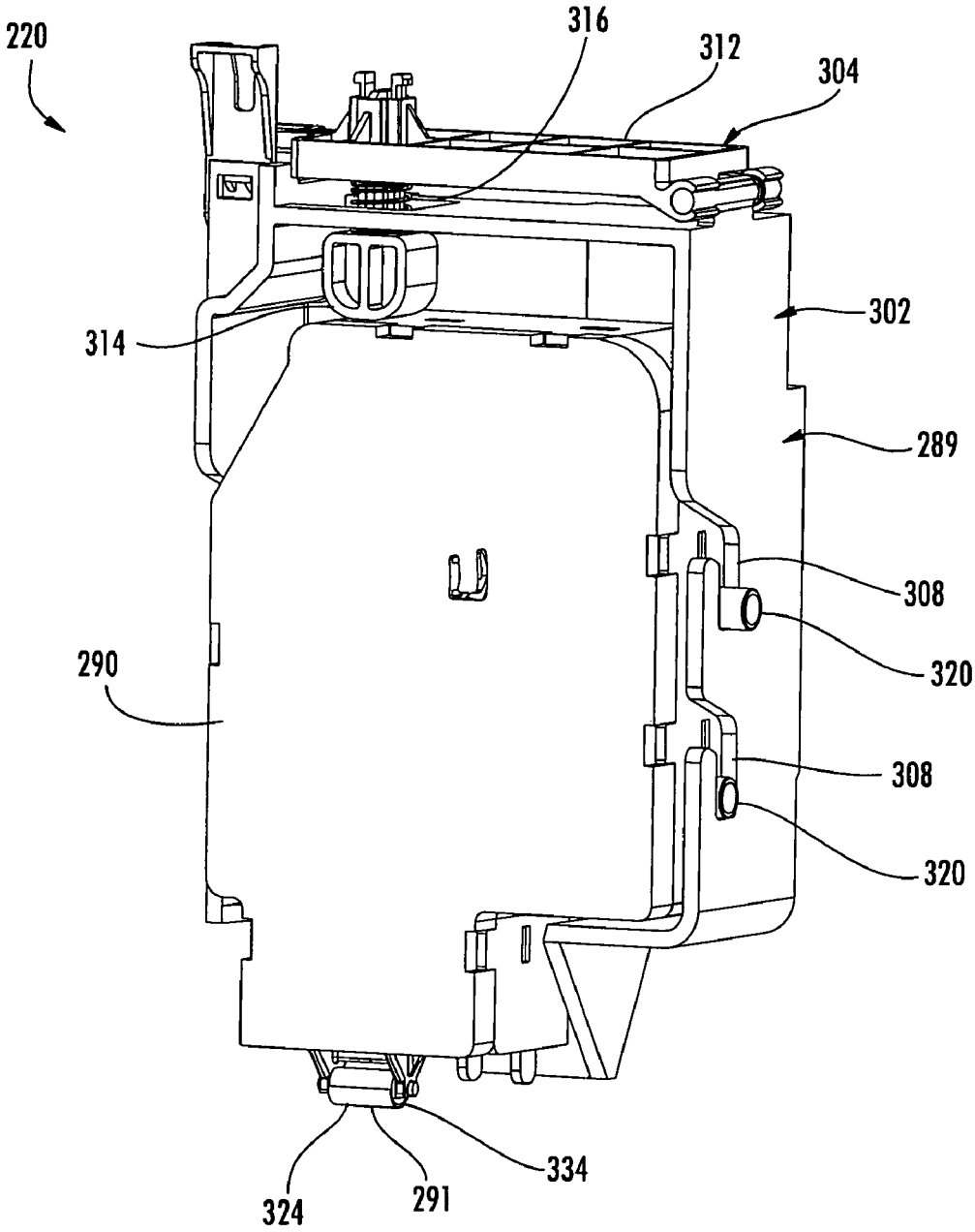
FIG. 5 is a top perspective view of a cleaning device of the cleaning station of Figure numeral for according to an example embodiment.

Cleaning device 287 comprises a mechanism configured to be brought into contact with platform surface 272 to wipe and remove residual ink from platform surface 272 of tray 226. In the example illustrated, cleaning device 287 includes a support or carrier 289 and a cleaning cartridge 290. As shown by FIGS. 4 and 5, carrier 289 comprises a framework, housing or receiver configured to be removably connected to or removably receive and support cartridge 90 and a suspended location opposite to an above a path of shuttle tray 26. FIG. 4 illustrates cartridge 290 removed from carrier 289. FIG. 5 illustrates cartridge 290 received by carrier 289. In the embodiment illustrated, carrier 289 is configured to removably receive cartridge 290. Carrier 289 includes body 302 and bias 304. Body 302 comprises one or more walls which form a cavity 306 configured to at least partially received cartridge to 90. Body 306 includes one or more slots 308 configured to secure cartridge 290 within cavity 306 and to also die movement of cartridge 290 within cavity 306 as cleaning surface 291 is pressed against platform surface 272 (shown in FIG. 3). Although illustrated as forming a generally rectangular cavity 306, body 302 may have various sizes, shapes and configurations depending upon the configuration of cartridge 290.

Bias 304 comprises a compressible mechanism configured to resiliently urge cartridge 290 and cleaning surface 291 in a downward direction (as seen in FIG. 4 and as indicated by arrow 310) towards surface 272 (shown in FIG. 3). Bias 304 is compressible such that bias 304 applies a downward force to cartridge 290 to ensure that cleaning surface 291 is pressed against platform surface 272 with sufficient force for cleaning surface 272.

In the particular example illustrated, bias 304 includes latch 312, bumper 314 and compression spring 316. Latch 312 comprises a member pivotably coupled to body 302 between a withdrawn position (shown in FIG. 4) and a biasing position (shown in FIG. 5). In the biasing position, latch 312 is latched or snapped and retained relative to body 302 with bumper 314 projecting into cavity 306 into engagement with cartridge 290. In the withdrawn position, bumper 314 is withdrawn from cavity 306, permitting insertion of cartridge 290 or withdrawal of cartridge 290.

Bumper 314 comprises a member movably supported relative to latch 304 so as to move between an extended position and a retracted position with respect to latch 312. Compression spring 316 resiliently bias is bumper 314 to the extended position. As shown in FIG. 5, when latch 312 is in the biasing position, spring 316 resiliently urges bumper 314 against cartridge 290 urging cartridge 290 downward.

Figure 6:
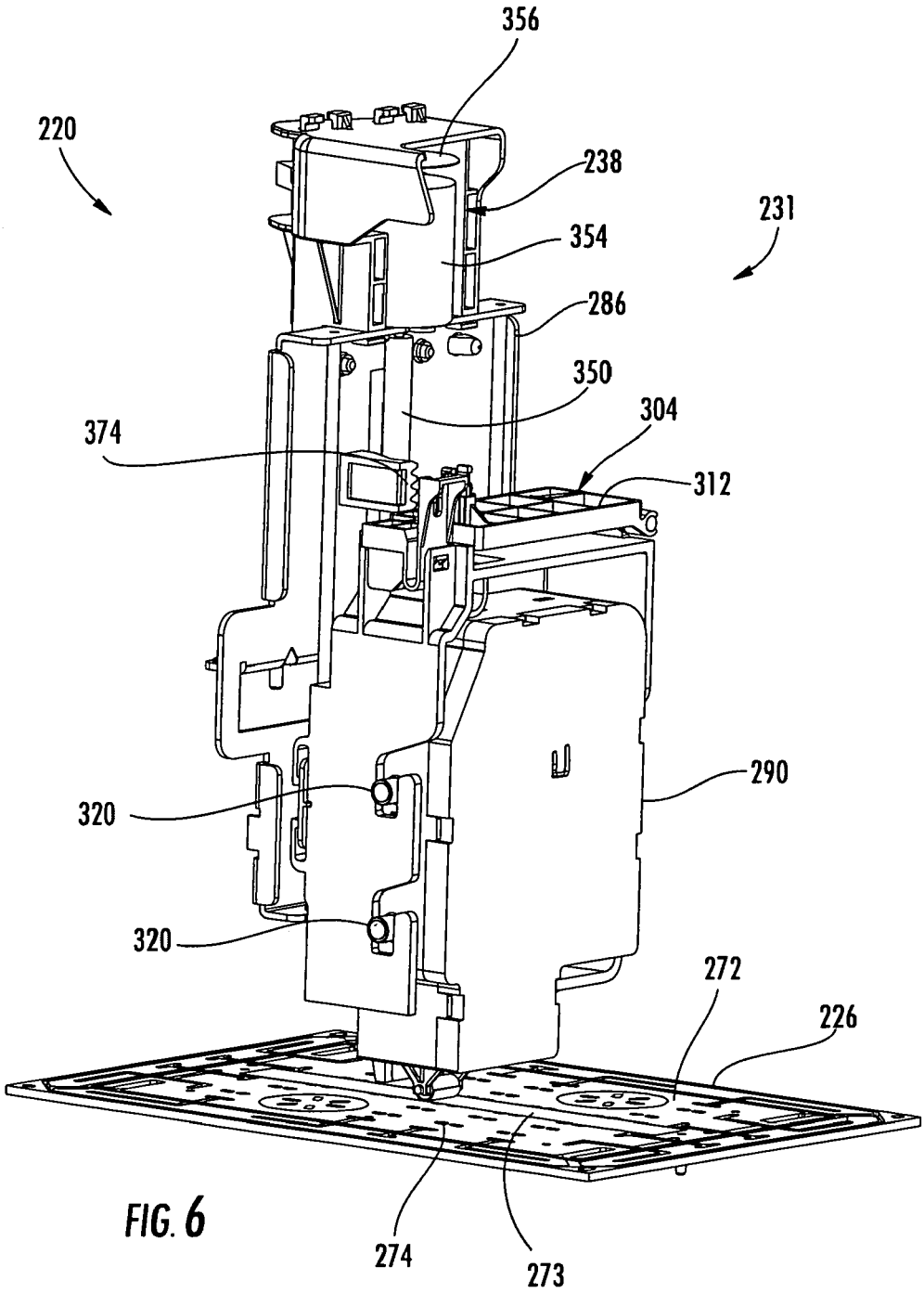
FIG. 6 is a top perspective view of the cleaning station of FIG. 3 illustrating the cleaning device in contact with the tray according to an example embodiment.

As shown by FIG. 6, actuator 388 is configured to lower carrier 289 and cartridge 290 towards surface 272 a sufficient distance such that cleaning surface 291 would extend lower than surface 272 but for being stopped by surface 272. As a result, cleaning surface 291 is pressed against surface 272 and compression spring 316 is compressed between bumper 314 and latch 312. As shown by FIG. 6, this also results in pins 320 of cartridge 290 riding up from the floors of their respective slots 308. Consequently, compression spring 316 takes up any fabrication or assembly tolerances, ensuring that cleaning surface 291 is always in contact with surface 272 and conforms to any irregularities along surface 272.

Figure 7:
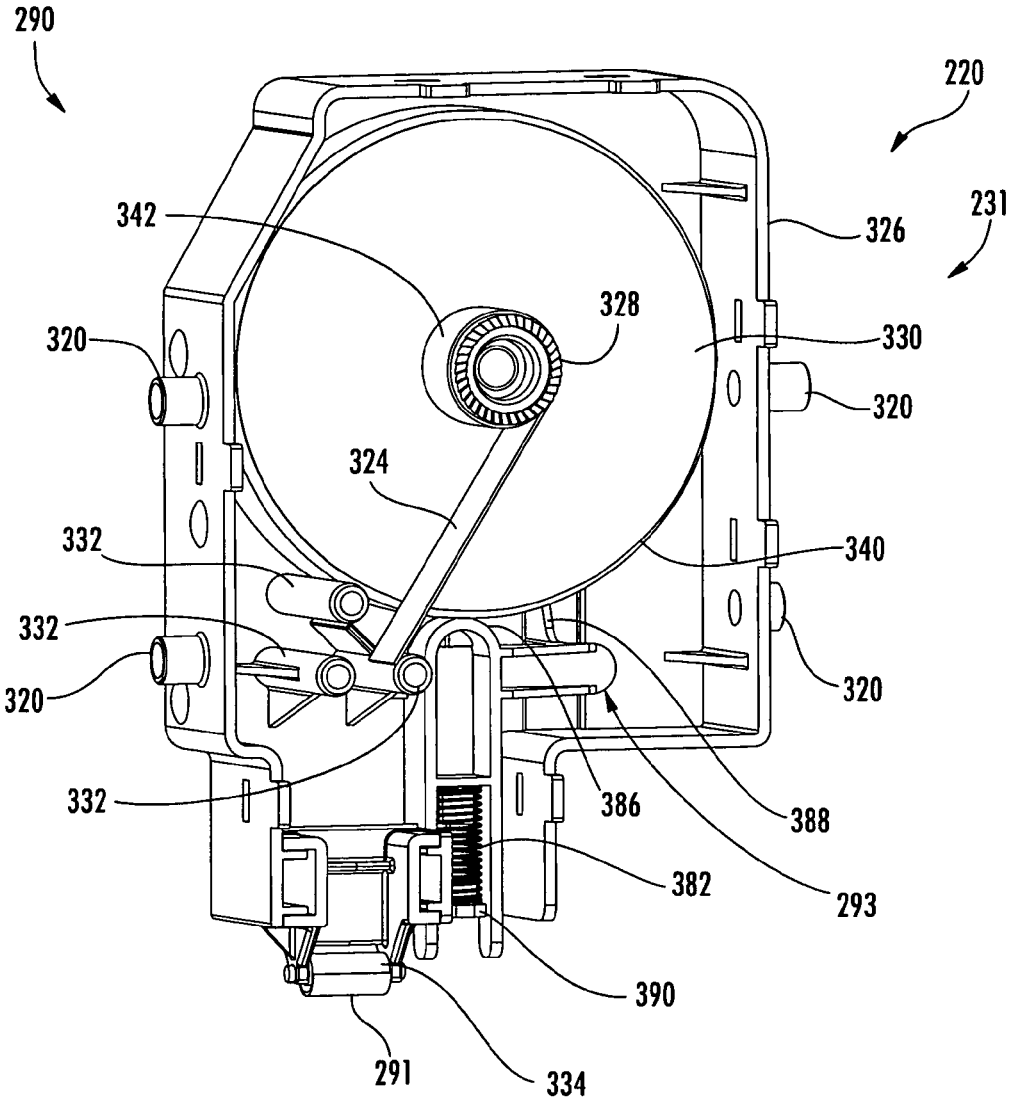
FIG. 7 is a top perspective view of a cartridge of the cleaning device of FIG. 6 according to an example embodiment.

FIG. 7 illustrates cartridge 290 in more detail. As shown by FIG. 7, cartridge 290 comprises a substantially self-contained unit configured to be removably coupled to carrier 289 and providing cleaning surface 291. Cleaning surface 291 is configured to be brought into contact with platform surface 272 so as to remove residual printing material, such as residual ink, from platform surface 272 of tray 226.

In the particular embodiment illustrated, cartridge 291 is configured to contain and support a web 324 of absorbent cleaning material. As shown by FIG. 7, cartridge 290 includes body 326, spindle 328, divider 330, web guides 332 and pressure roller 334. Body 326 comprises a structure at least partially surrounding web 324 and supporting those structures that died feeding and retrieval of web 324. As noted above, body 326 includes projections 320. Projections 320 comprise pins or rods extending from a remainder of housing 326 and configured to be received within slots 308. Projections 320 assists in datuming cartridge 290 within carrier 289, removably retaining cartridge 290 within carrier 289 and guiding movement of cartridge 290 within carrier 289 as shown in FIG. 6. In other embodiments, carrier 289 may alternatively include projections while cartridge 290 includes slots or other detents. In yet another embodiment, carrier 289 and cartridge 290 may include other mating or cooperating structures that retain cartridge 290 in a coupled state to carrier 289.

Spindle 328 comprise a structure rotationally supported by housing 326 and configured to form an axis about which web 324 may be wound or unwound. In the particular embodiment illustrated, spindle 328 is secured are connected to web 324 such that rotation of spindle 328 results in web 324 being wound about spindle 328. Divider 330 is supported along spindle 328 and serves as a dividing structure or plate for separating portions of web 324 being on wound from spindle 328 from those portions of web 324 being unwound from supply roll 340. Those portions of web 324 being unwound comprise or form a supply roll 340 of web 324 while those portions of web 324 being wound about spindle 328 form a take-up roll 342. In other embodiments, separate spindles may be provided for supply roll 340 and take up roll 342.

Web guides 332 comprise charge is configured to guide movement of Web 324 from supply roll 340 and take up roll 342 across pressure roller 334. In the particular example illustrated, guides 332 comprise rods or rollers about which web 324 partially winds or wraps as it travels to and from pressure roller 334. In other embodiments, guides 332 may have other configurations and may be divided at other locations.

Pressure roller 334 comprises a roller rotationally supported at a lower end of body 326 configured to support web 324 so as to form cleaning surface 291 which is provided by web 324. In the particular embodiment illustrated, roller 334 comprises a compressible or compliant roller. As a result, roller 334 enables web 324 to better conform to minor surface irregularities on surface 272. In the example illustrated, roller 334 comprises a foam roller. In other embodiments, roller 334 may comprise a rubber roller or an otherwise incompressible roller. In still other embodiments, web 324 may be stretched or extended across a plate so as to form cleaning surface 291.

In other embodiments, cartridge 290 the alternatively support other structures which form cleaning surface 291, without web 324. For example, cleaning surface 291 may alternatively comprise a flexible or elastomeric material, such as a rubber or rubber-like wiping blade or roller. In another embodiment, cleaning surface 72 may comprise an absorbent material such as an absorbent pad or an absorbent roller.

Figure 8:
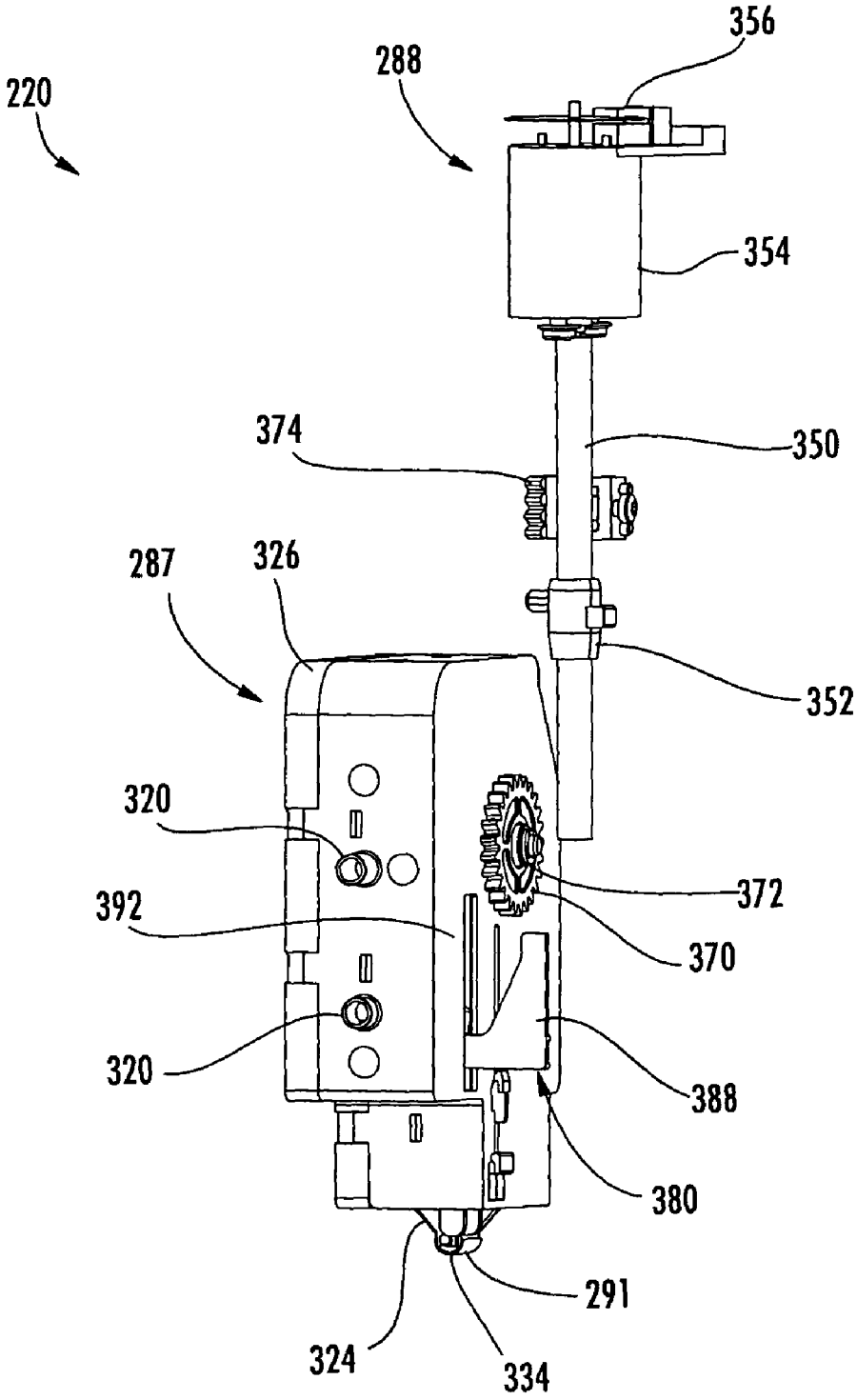
FIG. 8 is a top perspective view of the cleaning station of FIG. 6, illustrating a web advancement system in a first state according to an example embodiment.

FIG. 8 illustrates actuator 288. Actuator 288 comprises a mechanism configured to selectively raise and lower cleaning device 287, including carrier 289 and cartridge 290, with respect to tray 226 (shown in FIG. 3). In particular, actuator 288 is configured to raise cleaning device 287 when shuttle transport 228 (shown in FIG. 3) is moving tray 226 past cleaning station 231 or after platform surface 272 has been cleaned. Actuator 288 is configured to lower cleaning device 287 and position cleaning surface 291 into contact with platform surface 272 when tray 226 is positioned by shuttle transport 228 opposite to cleaning station 231 and when platform surface 272 is to be cleaned.

Figure 10:
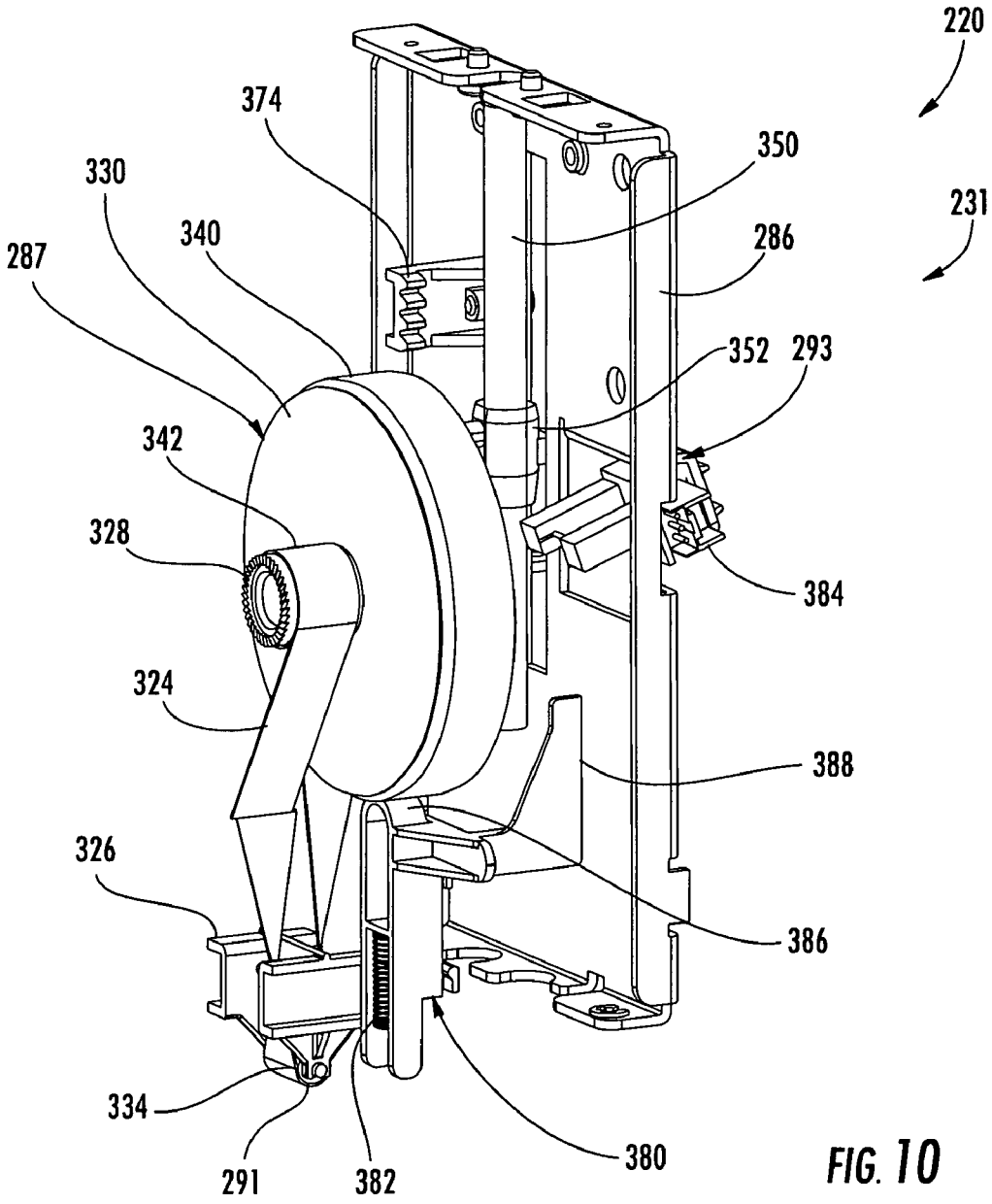
FIG. 10 is a top perspective view of the cleaning station of FIG. 6, illustrating a web sensing system in a first state according to an example embodiment.

In the particular example illustrated, actuator 288 includes shaft 350, nut 352, servomotor 354 and encoder 356. Shaft 350 comprise elongate lead screw threadably received within nut 352 which is connected to carrier 286 as shown in FIG. 10. Shaft 350 has an upper end secured to an output shaft of servomotor 354. Encoder 356 is secured to an output shaft of the servomotor 354 so as to sense rotation of motor 354. To raise and lower carrier 289 and cartridge 290, motor 354 is rotated so as to rotate shaft 350 and raise or lower nut 352 and carrier 289. Encoder 356 enables controller 35 (shown in FIG. 1) to identify the relative positioning or height of carrier 289 and cartridge 290 at any moment in time.

In other embodiments, actuator 288 may have other configurations. For example, in another embodiment, actuator 288 may include a stepper motor in place of servomotor 354. In yet other embodiments, actuator 288 may comprise a hydraulic cylinder assembly, a pneumatic cylinder assembly, an electric solenoid, a cam driven actuator or other device configured to selectively raise and lower an object. Although actuator 288 is configured to move cleaning device 289 in directions substantially perpendicular to platform surface 272, in other embodiments, actuator 288 may additionally or alternatively be configured to move cleaning device 287 in directions parallel to platform surface 272. Although cleaning device 287 is illustrated as including carrier 289 and the removable cartridge 290, in other embodiments, cartridge 290 may be omitted, wherein cleaning surface 291 is provided directly as part of carrier 289. In some embodiments, actuator 288 may also be omitted.

Figure 9:
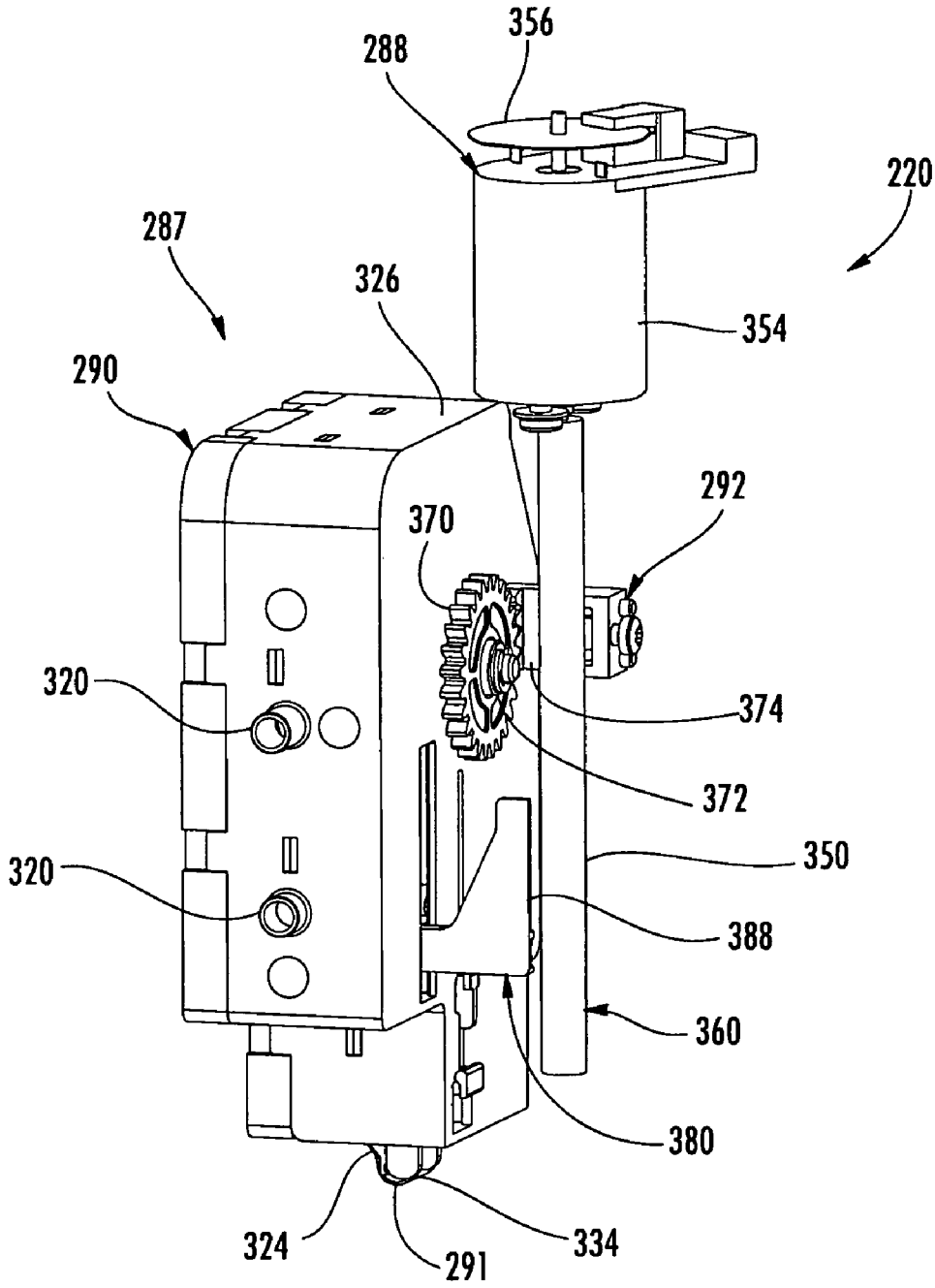
FIG. 9 is a top perspective view of the cleaning station of FIG. 6, illustrating the web advancement system and a second state according to an example embodiment.

FIGS. 8 and 9 illustrate web feeding system 292 in more detail. As shown by FIG. 9, web feeding system 292 includes spur or pinion gear 370, slip clutch 372 and rack gear 374. Pinion gear 370 is operably coupled to spindle 328 via slip clutch 372 such that rotation of pinion gear in a clockwise direction (as seen in FIG. 8) rotates spindle 328 in a corresponding direction such that web 324 is unwound from supply roll 340 and is wound about take-up roll 342. Pinion gear 370 is configured to mesh with rack gear 374 during raising and lowering of cleaning device 287 by actuator 288. In the example illustrated, pinion gear 370 is rotationally support adjacent to housing 326 of cartridge 290, wherein pinion gear 370 projects through an opening in a rear of carrier 289 (shown in FIG. 4). In another embodiment, pinion gear 370 may alternatively be located along an exterior of carrier 289, wherein pinion gear 370 is connected to a shaft extending through housing 326 of cartridge 290.

Slip clutch 372 is operably coupled between pinion gear 372 and spindle 328. Slip clutch 372 is configured to permit pinion gear 370 to rotate in a counterclockwise direction (as seen in FIG. 8) without transmitting torque to spindle 328 and without rotating spindle 328. As a result, lowering of clean device 287 by actuator 288 does not result in further advancing of web 324. In other embodiments, slip clutch may be omitted where advancement of web 324 is to occur during both raising and lowering of cleaning device 287.

Rack gear 374 is stationery supported by frame 286 so as to be along a line of travel of pinion gear 370 as cleaning device 287 is raised and lowered by actuator 288. As shown by FIG. 9, raising and cleaning device 287 moves of pinion gear 370 into meshing engagement with rack your 374. Continued upward movement of cleaning device 287 by actuator 288 rotates pinion gear 370 along rack gear 374. This results in controlled rotation of spindle 328 and controlled advancement of web 324. Consequently, a fresh or clean unused supply of web 324 is positioned across roller 334 (shown in FIG. 7), ready for the next cleaning pass across surface 272 (shown in FIG. 3). When actuator 288 lowers cleaning device 287, rotation of pinion gear 370 along rack gear 374 does not result in rotation and further advancement of web 324 as slip clutch 72 slips or rotates. Overall, web advancement system 292 provides a less complex and cost-effective means for advanced web 324 using the same actuator 288 that is also used to raise and lower cleaning device 287.

In other embodiments, web advancement system 292 may have other configurations. For example, in other embodiments, an additional motor, such as an additional servomotor or stepper motor, may alternatively be dedicated for rotating spindle 328 and feeding web 324. As noted above, in embodiments where a roll of web material is not employed, web advancement system 292 may be omitted.

FIGS. 10 and 11 illustrate web sensing system 293. Web sensing system 293 is configured to sense and detect the amount of web a roll 324 used, the amount of web 324 remaining, the current outer diameter of supply roll 340 and the current outer diameter of the take-up roll of roll 342. This detected information may be communicated to an operator or user to facilitate timely replacement of web 324 when the supply of web 324 has been exhausted or is approaching exhaustion. This detected information is also used by controller 35 (shown in FIG. 1) to control actuator 288 and web advancement system 292 such that a desired or predetermined extent of web 324 is consistently advanced.

Web sensing system 293 includes indicator 380, bias 382, sensor 384 and sensor 356 (shown in FIG. 8 and also utilized as part of actuator 288). Indicator 380 comprises a structure movably supported and guided by body 326 of cartridge 290. In one embodiment, indicator 380 is slightly coupled to body 326 by a tongue 385 slidably received within a slot 387 (both of which are shown in FIG. 9). Alternatively, indicator 380 may be movably guided by a tongue and groove arrangement. In yet other embodiments, other mechanisms may be used to movably support and guide indicator 380.

Indicator 380 includes bumper 386 and the flag 388. Bumper 36 comprises of that portion of indicator 380 configured to bear against and abut an outer circumferential surface of supply roll 340 as supply roll 340 is being rotated and unwound. Flag 388 comprises that portion of indicator 380 configured to actuate or otherwise trip sensor 384 during movement of cleaning device 287 by actuator 288 and partially based upon the outer diameter of supply roll 340.

Bias 382 comprises one or more structures configured to resiliently bias or urge bumper 386 of indicator 380 towards and against the outer circumferentially surface of the supply roll 340. In the example illustrated, bias 382 comprises a compression spring captured between indicator 380 and a support surface 390 (shown in FIG. 7). Bias 382 is configured to maintain bumper 386 against the outer circumferential surface of supply roll 340 from when supply rolled 340 has its largest outer diameter to when supply rolled 340 is exhausted and has its smallest outer diameter. In other embodiments, bias 382 may have other configurations for resiliently biasing bumper 386 against the outer circumvention surface of supply roll 340. For example, in another embodiment, bias 382 may comprise a tension spring having a first end coupled to indicator 380 and a second end coupled to a portion of body 326.

Sensor 384 comprises one or more sensing device is configured to detect the positioning or presence of flag 388 which corresponds to the outer diameter of supply rolled 340 and the corresponding outer diameter of take-up roll 342. In the example illustrated, sensor 34 comprises a photo optic detector configured to be tripped as flag 388 is positioned across a photo emitter and an optical detector to block or attenuate light from the emitter before it reaches the optical detector.

In the example illustrated, sensor 384 is stationery supported by frame 286 and, in conjunction with 356 (described above) indicates to controller 35 (shown in FIG. 1) the amount of web a roll 324 used, the amount of web 324 remaining, the current outer diameter of supply roll 340 and the current outer diameter of the take-up roll of roll 342. In particular, as shown by FIGS. 10 and 11, as supply rolled 340 of web 324 is used and depleted, the diameter of supply rolled 340 decreases while the diameter of take-up roll 342 correspondingly increases. Bias 32 maintains bumper 36 against the shrinking outer diameter of supply roll 340. As a result, flag 388 of indicator 380 rises or moves upwardly relative to body 326. In the example illustrated, flag 388 rises relative to body 326 through a slot or other opening 392 (shown in FIG. 8). Because flag 388 has a higher relative position relative to body 326 of cleaning device 287, flag 388 will trip sensor 384 at an earlier time as body 326 and the remainder of cleaning device 287 is raised by actuator 288. Consequently, the extent to which cleaning device 287 has been lifted by actuator 288 at the time that sensor 384 is tripped will correspond to the outer diameter of supply roll 340 and the corresponding outer diameter of take-up roll 342. In the example illustrated in which sensor 356 comprises an encoder, controller 35 (shown in FIG. 1) counts the number of "clicks" or signals received from encoder 356 during lifting of cleaning device 287 until sensor 34 is tripped to determine the current outer diameter of supply roll 340 and the corresponding outer diameter of take-up roll 342.

Based upon the determined outer diameters, controller 35 controls and adjusts the angular extent that spindle 328 is rotated to provide a consistent advancement of web 324 despite the ever-changing outer diameters of supply roll 340 and take-up roll 342. In particular, as the outer diameter of supply roll 342 increases, to maintain a consistent advancement of web 324, spindle 328 is rotated through a smaller angular extent. In the example illustrated, as the diameter of take-up roll 342 decreases, controller 35 (shown in FIG. 1) generates control signals directing actuator 288 to reduce the extent to which cleaning device 287 is raised and the corresponding extent that pinion gear 370 is rolled along rack gear 374 such that spindle 328 is also rotated through a smaller angular extent. Overall, web sensing systems 293 provides a less complex and cost-effective arrangement for sensing and determining use of web 324 to provide consistent advancement of web 324.

In other embodiments, web sensing system 293 may have other configurations. For example, in other embodiments, sensor 384 may alternatively be provided as part of carrier 289 or cartridge 290, wherein sensor 34 is configured to detect movement of flag 388 without movement of cleaning device or 287 and without reliance upon sensor 356. In other embodiments, an encoder may be associated with spindle 328. In yet other embodiments, other sensing arrangements may be employed.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:

a tray having a tray surface;

a print device configured to print a first image of printing material upon the surface;

a sheet positioning system configured to position a sheet upon the tray such that the first image is transferred to a first side of the sheet; and a cleaning device configured to remove residual printing material from the tray surface.

2. The apparatus of claim 1 further comprising a transport configured to move the tray relative to the cleaning device as the cleaning device removes the residual printing material from the tray surface.

3. The apparatus of claim 1, wherein the cleaning device includes:

a wiping surface; and an actuator configured to move the wiping surface in a direction substantially perpendicular to the tray surface.

4. The apparatus of claim 1, wherein the print device is configured to print a second image of printing material on a second opposite side of the sheet while the sheet is supported by the tray.

5. The apparatus of claim 1, wherein the cleaning device includes a roll of cleaning material.

6. The apparatus of claim 5 further comprising:

a spool supporting the roll;

a pinion gear coupled to the spool; and a rack gear in meshing engagement with the pinion gear.

7. The apparatus of claim 6 further comprising an actuator configure raise or lower the spool and the pinion gear relative to the rack gear such that the pinion gear rotates the spool.

8. The apparatus of claim 6 further comprising a slip clutch operably coupled between the pinion gear and the spool such that the spool may move along the rack gear in one direction without corresponding rotation of the spool.

9. The apparatus of claim 1, wherein the cleaning device comprises:

a web support;

a web of cleaning material supported by the support and forming a supply roll and a take-up roll; and a sensing system configured to sense an outer diameter of at least one of the supply roll and the take-up roll.

10. The apparatus of claim 9, wherein the sensing system comprises:

a movable indicator resiliently biased into engagement with an outer circumferential surface of at least one of the supply roll and the take-up roll;

at least one sensor configured to sense positioning of the indicator.

11. The apparatus of claim 10 further comprising an actuator configured to raise and lower the support relative to the tray surface and wherein the at least one sensor comprises:

a first sensor configured to be tripped by the indicator during raising or lowering of the support; and a second sensor configured to sense either a time during which the support is lifted or lowered prior to tripping of the first sensor by the indicator or a position of the support when the first sensor is tripped by the indicator.

12. The apparatus of claim 11 further comprising:

a spool coupled to the support and supporting the take-up roll;

a pinion gear coupled to the spool; and a rack gear in meshing engagement with the pinion gear, wherein the actuator is configured to selectively raise the support and the pinion gear relative to the rack gear based upon signals from the first sensor and the second sensor.

13. The apparatus of claim 1, wherein the cleaning device comprises:

a carrier; and a cartridge having a cleaning surface configured to contact the surface of the tray, wherein the cartridge is removably coupled to the carrier.

14. The apparatus of claim 13 further comprising a compressible roller supporting the cleaning surface.

15. The apparatus of claim 13 further comprising:

a compressible bias resiliently urging the cartridge towards the tray surface; and an actuator configured to move the cleaning surface into contact with the tray surface while compressing the compressible bias.

16. The apparatus of claim 1 further comprising a transport configured to move the tray between a first position opposite the print device and a second position opposite the cleaning device.

17. A method comprising:

printing a first image of printing material upon a tray surface;

positioning a sheet upon the tray surface such that the first image is transferred to a first side of the sheet; and removing residual printing material from the tray surface.

18. The method of claim 17 further comprising printing a second image on a second side of the sheet while the sheet is supported by the tray surface.

19. The method of claim 17 further comprising moving the tray surface relative to the cleaning device as the cleaning device removes the residual printing material from the tray surface.

* * * * *